United States Patent [19]

Charron et al.

[11] 4,444,155

[45] Apr. 24, 1984

[54] SEALED HEAT EXCHANGER CHAMBER WITH DISPOSITION OF LONGITUDINAL WATER TUBES CONCENTRICALLY DISPOSED TO A CENTRAL BURNER

[75] Inventors: Jean-Claude Charron, Saint Maur; Philippe Mulsant, Villiers sur Marne, both of France

[73] Assignee: Societe Anonyme Saunier Duval Eau Chaude Chauffage, Montreuil, France

[21] Appl. No.: 315,416

[22] Filed: Oct. 27, 1981

[30] Foreign Application Priority Data

Oct. 31, 1980 [FR] France ..... 80 23288

[51] Int. Cl.[3] ..... F22B 5/02

[52] U.S. Cl. ..... 122/19; 122/155 R; 122/333; 122/494

[58] Field of Search ..... 122/14, 18, 19, 13 R, 122/16, 17, 155 R, 235 S, 249, 250 R, 333, 367 R, 494; 126/361, 350 R; 150/0.5, 51; 220/85 B; 138/26, 30

[56] References Cited

U.S. PATENT DOCUMENTS

| | | | |
|---|---|---|---|
| 1,406,478 | 2/1922 | Mote | 150/0.5 |
| 1,609,858 | 4/1926 | Bohon | 122/13 R |
| 1,665,924 | 4/1928 | Hicks | 122/367 R |
| 2,638,138 | 5/1953 | Proebstle | 150/51 |
| 3,938,475 | 2/1976 | O'Sullivan et al. | 122/333 |
| 4,253,426 | 3/1981 | Nishi et al. | 122/13 R |

*Primary Examiner*—Edward G. Favors
*Assistant Examiner*—Steven E. Warner
*Attorney, Agent, or Firm*—Kerkam, Stowell, Kondracki, & Clarke

[57] ABSTRACT

A gas-tight chamber for a heat exchanger has a shell (12) forming the gas-tight chamber made of a light flexible or semirigid material such as rubber or thin silicone-treated sheet material which, because of its low weight and relative flexibility, absorbs all the vibrations produced and maintained by the burners, which eliminates the noise. The exchangers have a layer of longitudinal water tubes arranged concentrically around a central burner.

7 Claims, 1 Drawing Figure

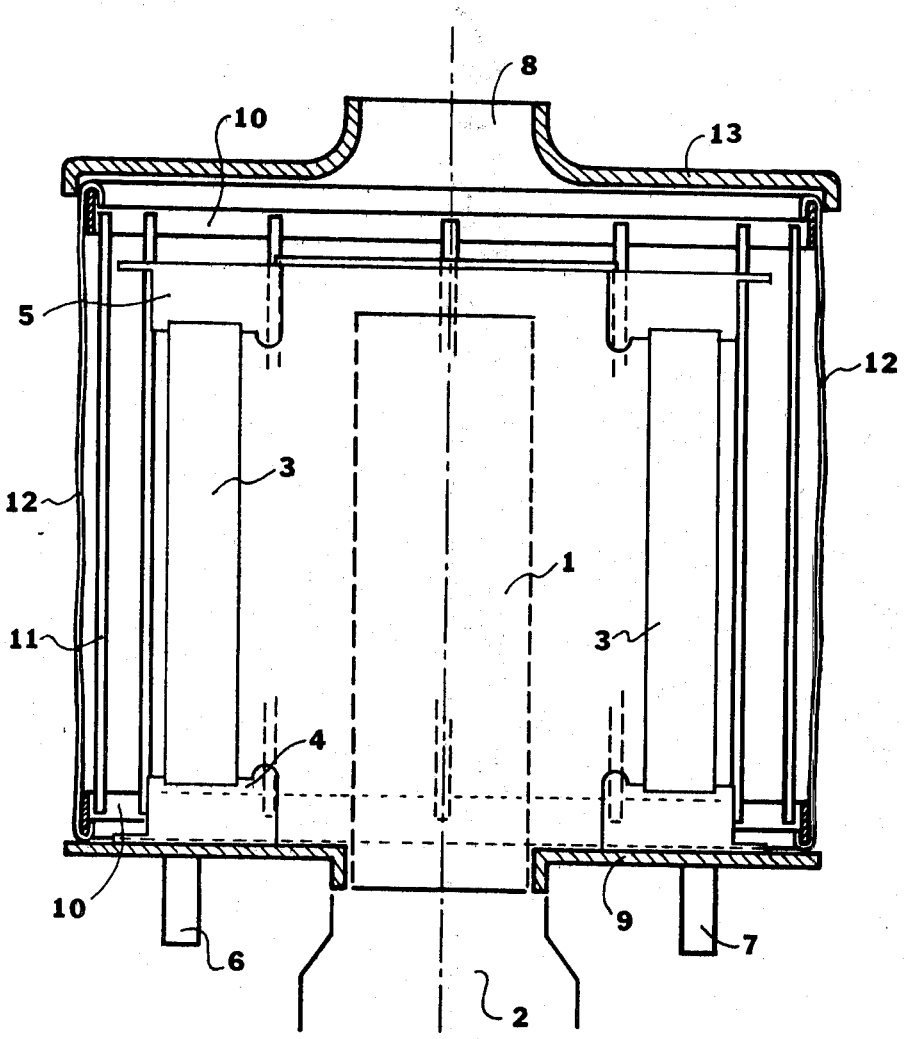
8
10
13
5
12
3
12
1
11
3
4
10
9
6
7
2

SEALED HEAT EXCHANGER CHAMBER WITH DISPOSITION OF LONGITUDINAL WATER TUBES CONCENTRICALLY DISPOSED TO A CENTRAL BURNER

BACKGROUND OF THE INVENTION

The invention refers to gas-heated hot-water boilers for household central heating and more precisely concerns a gas-tight chamber for heat exchangers of the type having water tubes surrounding a central burner.

Typically, the combustion chamber encloses a forced-air burner from which the gases are emitted radially and pass through the cylindrical layer of water tubes with which the thermal exchanges take place. The tubes are sized and arranged so as to obtain a laminar flow of gases and large heat exchange surfaces with them. These tubes are housed in a gas-tight chamber consisting of a shell the upper part of which communicates with an exhaust pipe. The combustion products are thus collected by this shell, which forms an exterior envelope around the combustion chamber. This shell, made—like all combustion chamber enclosures—of rigid sheet metal, is subjected to vibrations due to the compression waves emitted when the burner is lit and maintained by its flame front. These waves are reflected on the rigid wall of the shell which, by a phenomenon of resonance, emit a continuous, high-intensity noise, which is not acceptable for continuous-operation devices.

BRIEF SUMMARY OF THE INVENTION

The present invention provides a solution which avoids these drawbacks, in that the gas-tight shell forming the exterior chamber is made of a light, flexible or semirigid material such as rubberized fabric or plastic sheeting having characteristics of gas-tightness and temperature resistance at a low cost price, at least equivalent to the solid materials such as sheet metals and which, by preventing the sound-pressure waves emitted by the thermodynamic phenomena associated with the high thermal gradients from combustion, prevent the formation and maintenance of sound oscillations.

DESCRIPTION OF THE DRAWINGS

Particular characteristics and advantages of the invention will appear from the following description of a preferred embodiment thereof, with reference to the attached drawing showing a diagrammatic sectional view of the exchanger.

DESCRIPTION OF THE PREFERRED EMBODIMENT

At the center of the exchanger is arranged a forced-air burner 1 from which the air-gas mixture taken in through the lower manifold 2 escapes radially. The water tubes 3 form a cylindrical layer all around the burner; their shape and spacing is determined so as to present large heat exchange surfaces with the combustion gases. The water circulates in the tubes of this layer from a lower distributor ring 4 towards an upper distributor ring 5 and conversely, by means of a set of baffle-plates not shown, located in the rings. The feed of cold water and the lead-out of hot water at the level of the lower distributor are assured by the pipes 6 and 7, respectively. This cylindrical exchanger is housed in a gas-tight chamber which serves to collect the combustion gases passing through the layer of tubes 3 and discharges them through an upper opening 8.

The chamber is made in the following way. A lower round base 9 supports the exchanger proper by means of the distributor ring 4 and the burner. It is pierced with suitable holes for the passage of the water feed and discharge pipes 6 and 7, for the passage of the gas-mixture feed manifold 2, and for any discharge of condensation water. The base 9 also serves to support a cylindrical frame formed by two hoops 10 connected by vertical struts 11. This frame is covered by a flexible or semirigid material 12 such as rubberized or silicone-coated material constituting the circular watertight shell of the chamber and having good gas-tightness and temperature-resistant characteristics at low cost. The frame is in addition topped by a cover 13 provided with a discharge hole 8. It is thus housed between the cover and the base, tightness being assured by the flexible material being folded back over the edge of the hoops. This flexible shell 12, because of its low weight and relative flexibility, prevents sound oscillations from being reflected and maintained, which eliminates noise.

The invention is not limited to this form of realization but on the contrary encompasses all constructive variants.

According to another embodiment not shown, the flexible envelope 12 is stretched directly between the cover and the base, provided for this purpose with grooves and/or various appropriate hooking devices. This hooking obviously provides for tightness between the flexible shell, the cover and the base.

What we claim is:

1. A gas-tight combustion chamber for a heat exchanger of the type having water tubes arranged concentrically around a forced-air burner, and elements for holding the water tubes in place, said combustion chamber enveloping the water tubes and serving to collect and discharge combustion products into a chimney, and said combustion chamber comprising:

an air-tight and light flexible rubberized sheet material cylindrical shell impervious to gases;

an upper cover (13) and a lower base (9); and a cylindrical frame support on which said shell is mounted, said frame support tightly positioning said shell between said upper cover and said lower base wherein said flexible cylindrical shell constitutes means for prevention of the sound-pressure waves produced by the thermodynamic phenomena associated with high thermal gradients resulting from combustion.

2. A gas-tight chamber according to claim 6 wherein said cylindrical frame comprises two spaced hoops (10) connected by vertical struts (11).

3. A gas-tight chamber according to claim 2, wherein said flexible cylindrical shell is mounted to said frame by upper and lower edge portions of the flexible material being folded back over an edge of the hoops (10).

4. A gas-tight chamber according to claim 1, wherein said shell is held between the upper cover (10) and the lower base (9) and which further comprises means for directly hooking said shell to said lower base for gas-tightness.

5. A gas hot water boiler comprising:

a heat exchanger having water tubes arranged concentrically around a forced-air burner and elements for holding the water tubes in place;

a combustion chamber enveloping said heat exchanger for collecting and discharging combustion products into a chimney, said combustion chamber comprising an air-tight and light flexible rubberized sheet material cylindrical shell impervious to gases, an upper cover and a lower base, and a cylindrical frame support on which said shell is mounted, said frame support tightly positioning said shell between said upper cover and said lower base wherein said combustion chamber constitutes means for prevention of the sound-pressure waves produced by the thermodynamic phenomena associated with high thermal gradients resulting from combustion.

6. A gas hot water boiler in accordance with claim 5, wherein said cylindrical frame comprises two spaced hoops connected by vertical struts.

7. A gas hot water boiler in accordance with claim 6, wherein said flexible cylindrical shell is mounted to said frame by upper and lower edge portions of the flexible material being folded back over edges of said hoops.

* * * * *